United States Patent [19]

Long

[11] Patent Number: 4,903,600

[45] Date of Patent: Feb. 27, 1990

[54] PRODUCT COLLATOR IMBRICATOR AND PRINTER

[76] Inventor: John A. Long, 41 Lamont Ave., Scarborough, Ontario, Canada, M1S 1A8

[21] Appl. No.: 342,322

[22] Filed: Apr. 24, 1989

[51] Int. Cl.[4] ..... B41F 1/34

[52] U.S. Cl. ..... 101/485; 101/2; 270/1.1; 271/151; 198/462

[58] Field of Search ..... 101/2, 232, 485; 198/644, 437, 462; 414/789.6, 791.6; 270/1.1, 54, 55, 58; 271/151; 400/625

[56] References Cited

U.S. PATENT DOCUMENTS

| | | | |
|---|---|---|---|
| 2,133,261 | 10/1938 | Wolff | 270/1.1 |
| 2,976,803 | 3/1961 | Van Marle | 101/2 |
| 3,427,655 | 2/1969 | Woodside . | |
| 3,995,545 | 12/1976 | Romeo et al. | 101/2 |
| 4,027,142 | 5/1977 | Paup et al. | 270/1.1 |
| 4,034,974 | 7/1977 | Maopolski . | |
| 4,285,607 | 8/1981 | Steinhilber . | |
| 4,313,600 | 2/1982 | Mosburger . | |
| 4,395,031 | 7/1983 | Gruber et al. | 270/55 |
| 4,458,892 | 7/1984 | Nozawa . | |
| 4,533,132 | 8/1985 | Wangermann | 270/55 |
| 4,555,101 | 11/1985 | Stobb . | |
| 4,585,227 | 4/1986 | Muller . | |
| 4,667,953 | 5/1987 | Hirakawa . | |
| 4,730,820 | 3/1988 | Reist | 270/55 |
| 4,750,732 | 6/1988 | Hara . | |
| 4,752,684 | 6/1988 | Herrmann | 101/2 |
| 4,753,433 | 6/1988 | Rodi . | |
| 4,789,147 | 12/1988 | Berger et al. | 270/54 |
| 4,789,258 | 12/1988 | Gomoll . | |

*Primary Examiner*—Eugene H. Eickholt
*Attorney, Agent, or Firm*—Smart & Biggar

[57] ABSTRACT

An in-line array of product dispensers overlie a conveyor belt. An ink jet printer overlies the conveyor belt downstream of the product dispensers. Information identifying the product dispensers which hold the desired products for a particular set and the desired number of sets of that type are entered to a controller operatively associated with the product dispensers and the printer. The controller times the dispensing of products from the selected product dispensers so as to form imbricated sets of products on the conveyor belt. As the products in the imbricated set pass under the printer, the controller activates it to print desired information on the exposed portion of each product.

8 Claims, 1 Drawing Sheet

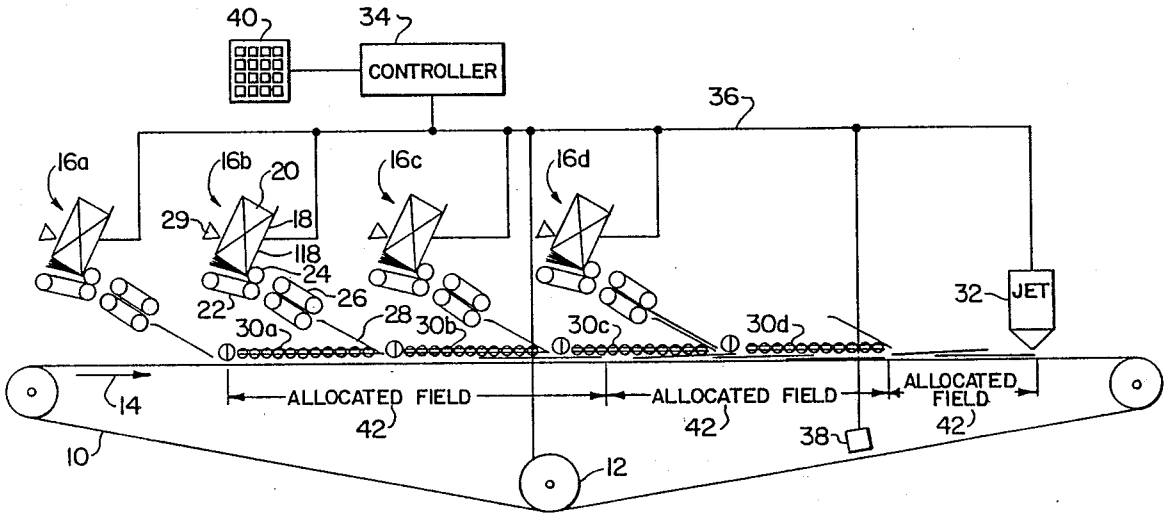
JET
32
ALLOCATED FIELD
42
38
36
30d
30c
30b
30a
16d
16c
16b
16a
12
14
10
CONTROLLER
34
40
28
26
24
118
18
20
22
29
ALLOCATED FIELD
42
ALLOCATED FIELD
42
ALLOCATED FIELD
42

PRODUCT COLLATOR IMBRICATOR AND PRINTER

This invention relates to a method and apparatus for high throughput printing of products, such as sheets of paper. In one embodiment the method and apparatus also provides for collating the products.

GB No. 1491491 issued Mar. 8, 1978 to John Albert Long, discloses a linear array of sheet dispensers overlying a slotted platform. A conveyor belt underlies the platform and drives a plurality of spaced pusher arms which are each aligned with a slot in the platform. The apparatus is timed so that a dispenser dispenses a sheet toward the platform as a pusher arm has moved a stack of sheets, comprising one sheet from each previous dispenser, underneath the dispensing dispenser. In this manner the apparatus collates the sheets forming vertically aligned stacks of sheets which are pushed to the end of the platform. With this known method of collating sheets the vertically aligned stacks on the platform clearly may not be readily printed. Further, printing the sheets before they entered the dispensers would require individual handling of each sheet with a consequent penalty in the time to process the sheets. There is therefore a need for a means for high throughput printing and, preferrably, collating of products.

Accordingly, the present invention comprises apparatus for high throughput printing of products comprising: (a) conveyor means for conveying products in a forward feed direction; (b) at least one product dispenser for dispensing products to said conveyor means; (c) control means operatively connected to said at least one product dispenser for timing the dispensing of products so as to form an imbricated array of products on said conveyor means; (d) printer means associated with said conveyor means downstream of said at least one product dispenser for printing on the exposed portion of products in said imbricated array to form an imbricated array downstream of said printer means having products printed by said printer means.

The present invention also comprises a method for high throughput printing of sets of products comprising the steps of: (a) dispensing desired sets of products so that each set forms an imbricated array wherein each product of the set partially overlaps the next adjacent product so that each product has an exposed portion; (b) conveying said desired imbricated sets of products to a printing station; (c) printing on the exposed portion of at least some of the products in the desired imbricated sets of products.

The sole FIGURE, which is an example embodiment of the invention, comprises a schematic view of a product collator imbricator printer constructed in accordance with the invention.

Referring to the sole FIGURE, a conveyor means comprising conveyor belt 10 is driven by conveyor drive 12 in a forward feed direction illustrated at 14. At least one product dispenser overlies the conveyor belt 10. In the illustrative embodiment, four in-line product dispensers **16*a*, 16*b*, 16*c*, and 16*d* overlie the belt 10. Each product dispenser comprises a magazine 18 for holding a stack of products 20, a conveyor belt 22 at the base of the magazine having a co-operating roller 24 proximate one end thereof forming a nip with the conveyor belt 22, a pair of parallel adjacent conveyor belts 26 between the output of the nip and a guide shute 28**. The guide shute terminates proximate the conveyor.

The details of such a product dispenser are well known to those skilled in the art. Each product dispenser additionally includes an indicating means 29 which indicates the length of the products in the magazine: i.e., the indicating means indicates the dimension of the products in the magazine which is perpendicular to the front wall 118 of the magazine. This dimension of the products is parallel to the forward feed direction 14 when the products are dispensed to the conveyor belt 10.

A plurality of rollers or alley races **30*a*, 30*b*, 30*c*, and 30*d* overlie the conveyor belt 10 downstream of each of the product dispensers 16*a*, 16*b*, 16*c*, and 16*d***.

A printer means comprising jet printer 32 overlies the conveyor belt 10 downstream of the product dispensers.

A control means comprising a controller 34 (which may be a computer) is operatively connected via bus 36 to each of the product dispensers **16*a*, 16*b*, 16*c*, 16*d*, the jet printer 32, the conveyor drive 12, and a conveyor belt speed sensor 38. As well, the controller is connected to receive inputs from an input means comprising keyboard 40**.

In operation, products are added to the magazines of the product dispensers and a data base is input to the controller 34 by way of keyboard 40. This data base includes the following information:

(i) an indication of the recipients for orders;

(ii) an identification of the product dispensers which hold the products of each set of products comprised in each order;

(ii) the number of each set ordered; and (iii) an indication of the matter to be printed on the products of the order.

For example, a customer may wish to mail out one thousand sets comprising a cover letter with a sample of two products as inserts. Sheets for the cover letter may be in the last dispenser, **16*d*, and the two products in the dispensers 16*a* and 16*c*. Accordingly, the above information regarding this order may be entered at the keyboard 40**. In this regard it may be desired to print a UPC (universal product code) or POS (point of sale code) on each of the two products. This may be accomodated with an appropriate entry at the input means. A second order may comprise a mail order response for a product. Again it may be desired to print a cover letter as well as the UPC or POS code on the ordered product and this may be accomodated with the subject apparatus. With orders of this latter type it may be preferrable that the input means include an optical reader which could read the desired information from an order letter filled out by the customer.

After the information for a particular order is input, the controller may interrogate the indicating means of the product dispenser which holds the last product which will be dispensed in the set for an indication of the length of that product (i.e., the dimension of that product which will lie along the forward feed direction 14). The controller then divides the conveyor belt 10 into notional fields (illustrated in the sole FIGURE at 42) of a length equal to the length of the last product in the set plus the length of the exposed portion of each of the remaining products when the products form an imbricated set on the conveyor belt. Thus, for the first example order, assuming the cover letter was 11 inches long and each product insert was to have a two inch portion exposed in the imbricated set on the conveyor belt, then the allocated fields would be 15 inches in length.

After completing the necessary set-up for the order, if the apparatus is idle, the controller may then activate drive 12 to start the conveyor belt 10, monitoring its speed by means of indicator 38; otherwise it will queue up the order in memory while previous orders are processed.

When a field allocated to a order approaches the first product dispenser 16*a*, if the first product is part of the order, the controller 34 activates the dispenser to dispense a product so that the leading edge of the product is at the leading edge of the field. As the field advances to the second product dispenser 16*b*, if the second product is part of the order, the controller activates the dispenser to dispense a product. If this is the first product dispensed, dispensing is timed so that the leading edge of the product is at the leading edge of the field, otherwise, the dispensing is timed so that the subsequent product is dispensed with its leading portion in overlapping relation with the trailing portion of the previous product leaving a preset leading portion of the previous product exposed on the conveyor belt. This process is repeated as the field approaches each of the remaining product dispensers so that downstream of the last product dispenser there is a set of imbricated products in the field (with the last product having no product overlapping it) which just fills the field. The rollers 30*a*, 30*b*, 30*c*, and 30*d* act to assist in maintaining the products in contact with the conveyor belt 10.

In an alternate embodiment, the products may be dispensed so that the first product is dispensed with its trailing edge at the trailing edge of the field. Thereafter, the dispensing is timed for subsequent products so that they are dispensed with their trailing portion in overlapping relation with the leading portion of the previous product so that a preset trailing portion of each previous product is exposed on the conveyor belt. The last product dispensed is thus dispensed with no product overlapping it and so that its leading edge is at the leading edge of the field.

As illustrated in the FIGURE, the trailing edge of one field may comprise the leading edge of the subsequent field to maximize the throughput of the apparatus.

As the filled fields downstream of the last product dispenser pass to the ink jet printer 32, the controller sends control signals to the printer so that the desired information is printed on the exposed portions of the products in the field as the exposed portions pass under the printer. It may be that all of the products are to be printed or that only certain of the products in the set are to be printed and it will be seen that this latter possibility may easily be accomodated by the subject apparatus.

Downstream of the printer the sets of products may be squared or jogged into neat assembly for packaging or insertion into an envelope for addressing by conventional means known to those skilled in the art.

If the subject apparatus includes only a single product dispenser, a single product may be held in the magazine of that product dispenser and an endless array of imbricated products dispensed to the conveyor belt 10 for printing.

The number of product dispensers for the apparatus is chosen according to the application, and may comprise 25 or more.

Printing an imbricated array increases throughput in the same proportion as product length to print length. For example, if the products are all of a uniform length of ten inches and the exposed portion of each product on the conveyor belt (the print length) is two inches, then the throughput will be up to five times that of a one-up format.

While the input means has been described as a keyboard or optical code reader, clearly other input means such as a disk drive are also possible.

The subject apparatus may be used with any generally flat product that may be dispensed from a product dispenser and printed with a printer. Each dispenser may contain a product having a different thickness.

I claim:

1. A method for high throughput printing of sets of products comprising the steps of:

(a) dispensing desired sets of products so that each set forms an imbricated array wherein each product of the set, except the last product dispensed in the set, is partially overlapped by the next adjacent product so that each product has an exposed portion;

(b) conveying said desired imbricated sets of products to a printing station;

(c) printing on the exposed portion of at least some of the products in the desired imbricated sets of products.

2. The method of claim 1 including the step of determining the single dimension of the last product dispensed in each desired set which will lie along the length of the imbricated array and calculating the length of each imbricated array from this information and the desired length of the exposed portion of each of the remaining products in each said imbricated array prior to undertaking step (a) in order to facilitate the dispensing of desired sets of products in close proximity to one another.

3. Apparatus for high throughput printing of products comprising:

(a) conveyor means for conveying products in a forward feed direction;

(b) at least one product dispenser for dispensing products to said conveyor means;

(c) control means operatively connected to said at least one product dispenser for timing the dispensing of products so as to form an imbricated array of products on said conveyor means;

(d) printer means associated with said conveyor means downstream of said at least one product dispenser for printing on the exposed portion of products in said imbricated array to form an imbricated array downstream of said printer means having products printed by said printer means.

4. Apparatus for assembling and high throughput printing of sets of products comprising:

(a) conveyor means for conveying products in a forward feed direction;

(b) a plurality of product dispensers for dispensing products to said conveyor means;

(c) control means operatively connected to said plurality of product dispensers for selectively activating ones of said plurality of product dispensers and for timing the dispensing of products so as to form imbricated sets of products on said conveyor means whereby each product in a set of products, except the last product dispensed in the set, is partially overlapped by an adjacent product so that each product has an exposed portion which is not overlapped by an adjacent product;

(c) printer means associated with said conveyor means downstream of said plurality of product dispensers for printing on the exposed portion of products in said sets of imbricated products in order to form sets of imbricated products downstream of said printer means having products printed on by said printer means.

5. Apparatus as claimed in claim 3 further including:

(d) input means for indicating the ones of said plurality of product dispensers which hold the products of one or more desired sets of products, said control means being responsive to said input means.

6. Apparatus as claimed in claim 5 wherein each of said plurality of product dispensers include indicating means to indicate the single dimension of products therein which lies along said forward feed direction when said products are dispensed to said conveyor means and wherein said control means is responsive to said indicating means whereby said control means may calculate fields on said conveyor means of a length equal to said single dimension of the last product dispensed in a given imbricated set of products plus the length, lieing along said forward feed direction, of the exposed portion of each of the remaining products in said given imbricated sete of products in order to properly time the dispensing of products in said given imbricated set of products.

7. Apparatus as claimed in claim 6 wherein said control means is operatively connected to said printer means whereby said control means controls the timing of said printer means and the information printed by said printer means.

8. Apparatus as claimed in claim 7 wherein said input means is also for indicating the information that is to be printed on desired sets of products.

* * * * *